United States Patent [19]

Baker

[11] 4,441,398

[45] Apr. 10, 1984

[54] ANCHOR DEVICE FOR BASS DRUM

[76] Inventor: Newman T. Baker, 304 Catharine St., Philadelphia, Pa. 19147

[21] Appl. No.: 379,603

[22] Filed: May 19, 1982

[51] Int. Cl.[3] ..... G10G 5/00

[52] U.S. Cl. ..... 84/421; 84/453; 248/346

[58] Field of Search ..... D17/22; 84/280 C, 421, 84/422, 453; 248/346

[56] References Cited

U.S. PATENT DOCUMENTS

| | | | |
|---|---|---|---|
| 2,297,000 | 9/1942 | Kult | 84/453 X |
| 3,096,677 | 7/1963 | Ryan | 84/421 |
| 4,334,612 | 6/1982 | Beato | 84/453 X |

*Primary Examiner*—Lawrence R. Franklin

*Attorney, Agent, or Firm*—Eugene Chovanes

[57] ABSTRACT

An anchor for a bass drum or similar percussion instrument having a barrier secured to one end of a flexible foldable friction mat of a size capable of receiving the instrument at the barrier end and the player at the other end.

4 Claims, 7 Drawing Figures

40
46
41
43

41
40
43

43
46
46
4.
4.
40
47
41

6.
41
6.

41

46
40
42
43
41
45

23
22
48
47

ANCHOR DEVICE FOR BASS DRUM

BACKGROUND OF THE INVENTION

When bass drum players repetitively strike a bass drum with a foot pedal, the drum has a tendency to creep away from the player. This is an extremely bothersome problem.

As the bass drum is played in an orchestra in the well known manner, the drum sits on its side with the striking face toward the player who is engaged with striking cymbals and a snare drum and other instruments such as tom-toms. The player usually sits on a chair or stool and with his foot strikes a lever constructed for striking a mallet or beater against the drum face. The pedal which activates the beater arm is attached to the rim of the drum. However, the striking force of the beater head is perpendicular to the drum face so that the drum obviously has a force working to displace it in a direction away from the drummer.

The drummer generally depends on the weight of the drum itself to keep the drum from moving. Some drummers have improvised securing devices for instance, tying a rope to each side of the drum at the sides, and wrapping the rope around their chair. Other drummers bring a rug along which they roll out and on which at one end they place the drum. They place the chair on which they sit on the other end of the rug.

In some instances, non-slip drum holders have been provided as in U.S. Pat. No. 3,096,677 wherein rigid pads of non-slip material are unfolded to provide a flooring on which projections or abutments prevent the drum and accessory instruments from moving.

These prior art methods have been generally unsatisfactory, and the problem remains.

SUMMARY OF THE PRESENT INVENTION

The present invention provides a solution to the above problems. A thick ribbed rubber mat with the ribbing on the upper or near side extends along the floor with an abutment portion secured to one end. The player sits on a chair positioned at one end, and the drum is positioned at the other end of the mat up against the abutment.

The friction of the mat against the floor as well as the weight of the player on the mat prevents the mat from moving along the floor, and in turn the abutment on the mat anchors the drum.

Additional advantages of the invention as described above in addition to securing the drum from creeping, include:

(1) ease of transport of the anchor wherein the mat is rolled up around the barrier so that a compact roll ensues;

(2) an esthetically pleasing appearance is achieved when the anchor is in use, since the abutment can be made of an attractive hardwood and the mat is not particularly visible;

(3) the anchor device in no way interferes with the music or percussion qualities of the drum; that is, there is no dampening or deadening effect, nor is there any undesirable stress put on the drum so that it doesn't achieve its full music potential;

(4) a mat can be used on any type of flooring whether it is masonary, wood, carpet—whether high or low profile—even or uneven, since the mat simply conforms to the contour;

(5) the mat is comfortable to the drummer since the resiliency and the ribbing of the rubber give a certain amount of flexibility or bounce;

(6) the mat itself in no way detracts from the drum ensemble, since it is very thin and can be made of a suitable neutral color such as dark brown;

(7) the anchor is not expensive to manufacture and is simple, yet highly effective;

(8) it avoids damage to the floor, and this is particularly important since during an evening's performance there are countless beats made by the drummer and in some very active and enthusiastic music, the drummer exerts a lot of physical activity and cannot be restrained with the lingering thought that he might damage the floor;

(9) damage to the floor in the drum area is prevented from cigarettes and liquids including coffee and alcoholic beverages, and any other material associated with entertainment, dancing and the like;

(10) The anchor is compatible with any drum set and there is no need for a tailor-made anchor.

DESCRIPTION OF THE PREFERRED EMBODIMENT

Figures 1, 2, 3, 4, 5, 6, 7:
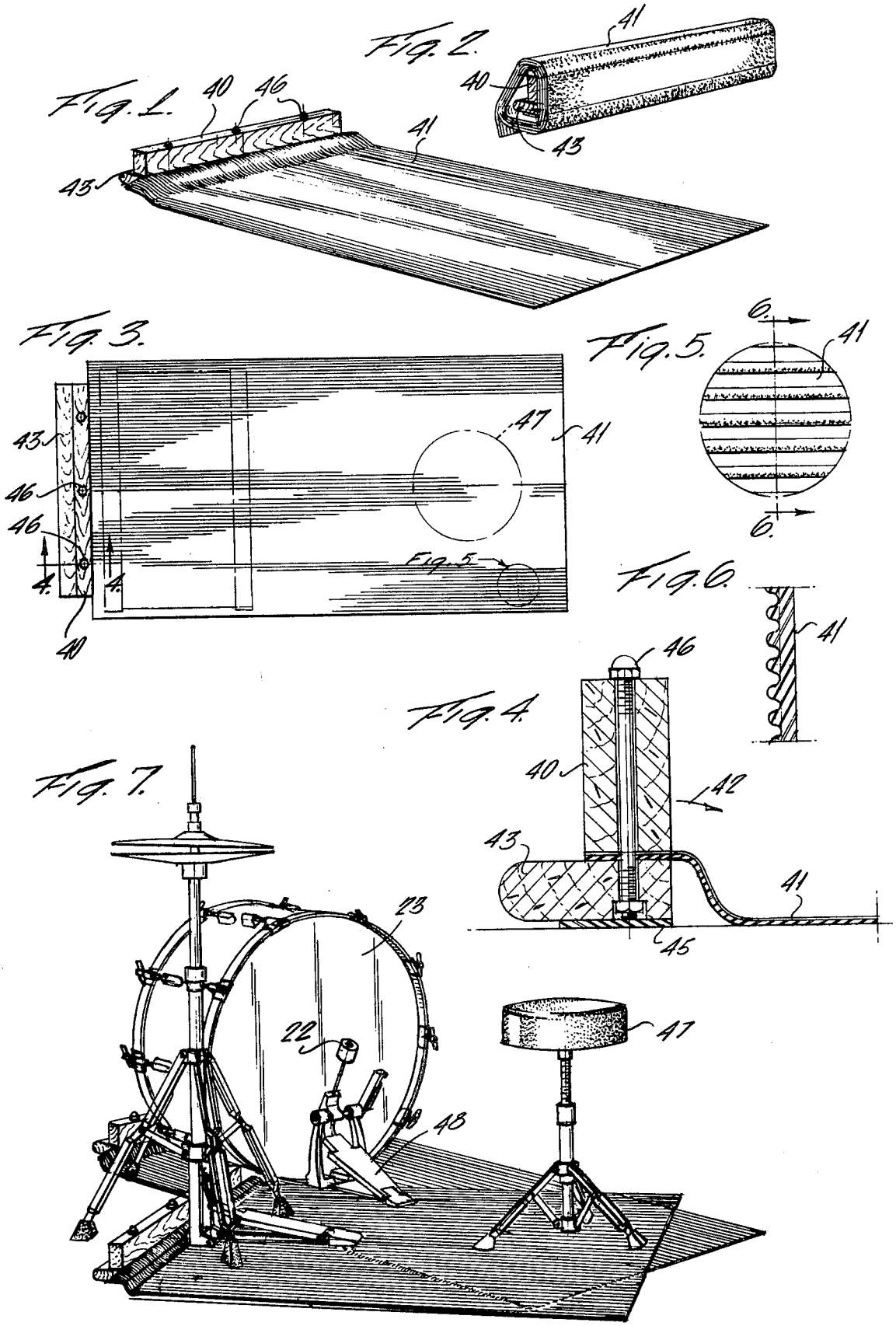
FIG. 1 is a perspective view showing the invention for a base drum anchor or any other foot-activated percussion instrument such as a cymbal stand.
FIG. 2 is a perspective view of the anchor assembly shown in a rolled and easily portable condition.
FIG. 3 is a plan view of the anchor as shown in FIG. 1 having positions of a base drum and drum throne shown in broken lines.
FIG. 4 is an enlarged fragmentary sectional elevational view taken on the line 4—4 of FIG. 3, showing details of construction.
FIG. 5 is an enlarged plan view of a portion of the anchor apron enclosed by the dot-and-dash circle on FIG. 3 and showing the enlarged configuration of the upper surface of the anchor apron.
FIG. 6 is a transverse sectional view taken on line 6—6 of FIG. 5.
FIG. 7 is a perspective view of the use of two anchors, one overlapping the other, and anchoring a bass drum and a cymbal stand.

In the anchor of the invention as shown in the drawings, a thick ribbed rubber mat of for instance ⅛" thickness with the ribs on the upper or near side, extends along the floor. The bass drum is placed against a barrier strip 40 which is secured to the mat as shown in detail in FIG. 4. The barrier strip 40 is desirably a hardwood block having holes vertically drilled therethrough. The mat 41 is secured for instance on the barrier strip at about 1" above the floor, so there is torque force as seen at 42 which keeps the barrier 40 from tipping.

A lower block 43 extends below barrier 40 and serves to secure the end of the mat 41 as shown in FIG. 4. The bolt nut 46 clamps barrier 40, strip 41, and portion 43 together.

The mat 41 is of a flexible material such as rubber and extends from the barrier as shown in for instance FIGS. 1 and 3 along the floor in a snug fashion. The mat 41 compensates for any floor irregularities.

A short portion of mat 45 is adhesively secured to the bottom of block 43 to provide a cushioning and gripping effect on the floor. The mat is made of any suitable dimension such as of a 5′ length and a 3′ width.

As seen in FIGS. 6 and 7, mat 41 has longitudinally extending ribs on the top thereof to provide a cushioning and friction effect.

In use, the drummer sits on stool 47 which is positioned at one end of the mat and secures the mat to the floor. The drum or other percussion instrument operated by the foot pedals is placed up against the barrier 40 and the player strikes the pedal 48 and the beater head 22 strikes the drum. The drum or other percussion instrument is kept from moving or creeping by barrier 40.

After use, the anchor can be readily rolled or compacted into a portable condition as shown in FIG. 2. The barrier 40 is simply used as a shaft upon which to wind the flexible mat. The anchor is then tucked in with the other musical equipment for transport.

In some instances, two mats are used, as shown in FIG. 7, in overlapping fashion so that for instance a cymbal floor stand can be positioned adjacent the bass drum with ready access to both instruments by the player. The mats can easily be positioned one with respect to another so that an infinite variety of locations can be created for the instrument combinations.

In view of my invention and disclosure, variations and modifications to meet individual whim or particular need will doubtless become evident to others skilled in the art, to obtain all or part of the benefits of my invention without copying the structure shown, and I therefore claim all such insofar as they fall within the reasonable scope and spirit of my claims.

Having thus described my invention, what I claim as new and desire to secure by Letters Patent is:

1. An anchor for a bass drum or other percussion instrument adapted for being repetitively struck by a player, comprising a flexible mat having barrier means at one end, an area adjacent the barrier means to receive the instrument, and an area at the end opposite the barrier means to receive the player, said barrier means including an upward extended barrier strip mounted on the upper surface of said flexible mat and transversely along and superimposed on an end edge thereof, a lower block positioned and extending along and below said barrier strip and mat, said block elevating said mat end edge and said barrier strip and thereby creating a resistive force to said barrier strip resisting tipping thereof by forces applied thereagainst by a said instrument, said mat being compactly foldable about the barrier means for transport, and unfolded on a floor when in use.

2. An anchor as claimed in claim 1, said barrier strip, said mat end edge and said lower block being interconnected.

3. An anchor as claimed in claim 2, and including a short mat portion adhesively secured to the bottom of said lower block to provide a cushioning and gripping effect on a supporting floor.

4. An anchor as claimed in claim 1, 2, or 3 wherein said block has a portion extending away from said mat and beyond said barrier means to provide a further resistive force opposing tipping of said barrier means by forces applied thereagainst by said instrument.

* * * * *